US005613178A

United States Patent [19]

Amico

[11] Patent Number: 5,613,178

[45] Date of Patent: Mar. 18, 1997

[54] ELECTRODED DONOR ROLL

[75] Inventor: Mark S. Amico, Rochester, N.Y.

[73] Assignee: Xerox Corporation, Stamford, Conn.

[21] Appl. No.: 520,223

[22] Filed: Aug. 28, 1995

[51] Int. Cl.[6] ..... G03G 15/08

[52] U.S. Cl. ..... 399/266

[58] Field of Search ..... 355/245, 246, 355/259, 261

[56] References Cited

U.S. PATENT DOCUMENTS

| | | | |
|---|---|---|---|
| 5,172,170 | 12/1992 | Hays et al. | 355/259 |
| 5,289,240 | 2/1994 | Wayman | 355/259 |
| 5,390,011 | 2/1995 | Theodoulou | 355/272 |
| 5,394,225 | 2/1995 | Prker | 355/259 |
| 5,413,807 | 5/1995 | Duggan et al. | 427/58 |
| 5,453,768 | 9/1995 | Schmidlin | 347/55 |
| 5,473,414 | 12/1995 | Thompson | 355/200 |

OTHER PUBLICATIONS

Xerox U.S. Serial No. 08/376,585, filed Jan. 23, 1995, Applicant: Rodriguez et al. (Not attached).

*Primary Examiner*—William J. Royer

*Attorney, Agent, or Firm*—H. Fleischer; J. E. Beck; R. Zibelli

[57] ABSTRACT

An apparatus in which a rotably mounted donor roll advances toner to an electrostatic latent image recorded on a photoconductive surface. The donor roll has a plurality of conductive electrodes mounted thereon which rotate in unison therewith. A resistive disk is connected electrically to each of the conductive electrodes. The resistive disk also rotates in unison with the donor roll. An electrically conductive brush is in sliding contact with the resistive member. A voltage source, mounted stationarily, is coupled electrically to the resistive member. The voltage applied to each conductive electrode varies as a function of the distance between the voltage source and that conductive electrode.

19 Claims, 4 Drawing Sheets

ELECTRODED DONOR ROLL

This invention relates generally to an electrophotographic machine, and more particularly concerns a donor roll having electrode wires integral therewith for use in a developer unit of a printing machine.

Generally, the process of electrophotographic printing includes charging a photoconductor surface to a substantially uniform potential and selectively discharging areas by exposure to light, thereby forming an electrostatic latent image of an original document being created. The electrostatic latent image is developed by bringing a developer material into contact therewith. Two component and single component developer materials are commonly used. A typical two component developer material has magnetic carrier granules with toner particles adhering triboelectrically thereto. A single component developer material typically uses a donor surface with triboelectrically held toner particles. Toner particles from the development zone are selectively attracted to the charged areas in the latent image and form a visible toner powder image on the photoconductive surface. The powder image is subsequently transferred to a sheet and heated to permanently fuse it to the surface of the sheet in imagewise configuration.

One type of scavengeless or non-interactive development system uses a donor roll for transporting charged toner to a development zone formed by a plurality of taut electrode wires in close proximity to the donor roll surface. High voltage AC is applied to the wires creating a toner cloud in the development zone. The electrostatic fields generated by the latent image attract toner from the toner cloud and develop the latent image without the scavenging interactions common in other development systems. A hybrid scavengeless development unit employs a magnetic brush roller for transporting carrier granules having toner particles adhering triboelectrically thereto. The donor roll and magnetic roll are electrically biased relative to one another so that toner is attracted to the donor roll from the magnetic roll. The AC activated electrode wires detach the toner particles from the donor roll creating a toner powder cloud in the development zone, and the latent image selectively attracts toner particles from the toner powder cloud. In this way, the latent electrostatic image recorded on the photoconductive surface can be developed with toner particles in such a way that previously deposited toner images are not disturbed.

In order to alleviate the problems associated with the use of electrically activated wires in the development zone, an electroded or commutated donor roll is used. This eliminates the contamination and vibrational instabilities associated with the use of individual wires for detaching the toner from the surface of the donor roll. However, it has been found that when an electroded donor roll is employed, electrical discharges frequently occur at the points of high voltage electrical commutation. Various types of donor rolls have hereinbefore been used as illustrated by the following disclosures, which may be relevant to certain aspects of the present invention:

U.S. Pat. No. 5,172,170

Patentee: Hays et al.

Issued: Dec. 15, 1992

U.S. Ser. No. 08/376,585

Applicant: Rodriguez et al.

Filed: Jan. 23, 1995

The relevant portions of the foregoing disclosures may be briefly summarized as follows:

U.S. Pat. No. 5,172,170 discloses a donor roll having a plurality of spaced apart electrical conductors located in grooves therein. The electrical conductors are electrically commutated by a brush adjacent to the development zone to supply high voltage AC to the electrodes which detaches toner from the donor roll surface and forms a toner cloud. In the development zone, toner particles are attracted from the toner cloud to the latent image. The latent image is developed with the toner particles.

U.S. Ser. No. 08/376,585 discloses a donor roll having a plurality of electrodes disposed about the circumferential periphery thereof. The donor roll is divided into a development area, a commutation area, and a grounding area. The latent image is developed with toner in the development area. The electrodes are electrically driven through a sliding contact made in the commutation area and electrically grounded in the grounding area. Electrodes are connected in pairs in the commutation area.

In accordance with one aspect of the present invention, there is provided an apparatus for developing a latent image recorded on a surface. The apparatus includes a movable donor member having a plurality of electrically conductive electrodes mounted thereon. A resistive member is connected electrically with the electrodes and moves in unison therewith. A stationary voltage source is coupled electrically to the resistive member 50 that the voltage applied to one of the conductive electrodes varies as a function of the distance between the electrode and the voltage source.

Pursuant to another aspect of the present invention, there is provided a donor roll for use in a developer unit of a printing machine. The donor roll is mounted rotatably. The donor roll has a plurality of electrically conductive electrodes mounted on its surface that rotate in unison therewith. A resistive member is connected electrically to the conductive electrodes and is adapted to rotate in unison therewith.

Still another aspect of the present invention is a printing machine having a latent image recorded on a surface. The improvement includes a movable donor member adapted to move toner adjacent the surface. A plurality of conductive electrodes are mounted on the donor member and are adapted to move in unison therewith. A resistive member is connected electrically to the plurality of electrically conductive electrodes is adapted to move in unison therewith. A voltage source, mounted stationarily, is coupled electrically to the resistive member so that a voltage applied to one of the plurality of electrically conductive electrodes varies as a function of the distance between the electrode and the voltage source.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 5 printing machine will be shown hereinafter schematically and their operation described briefly with reference thereto.

Figure 5:
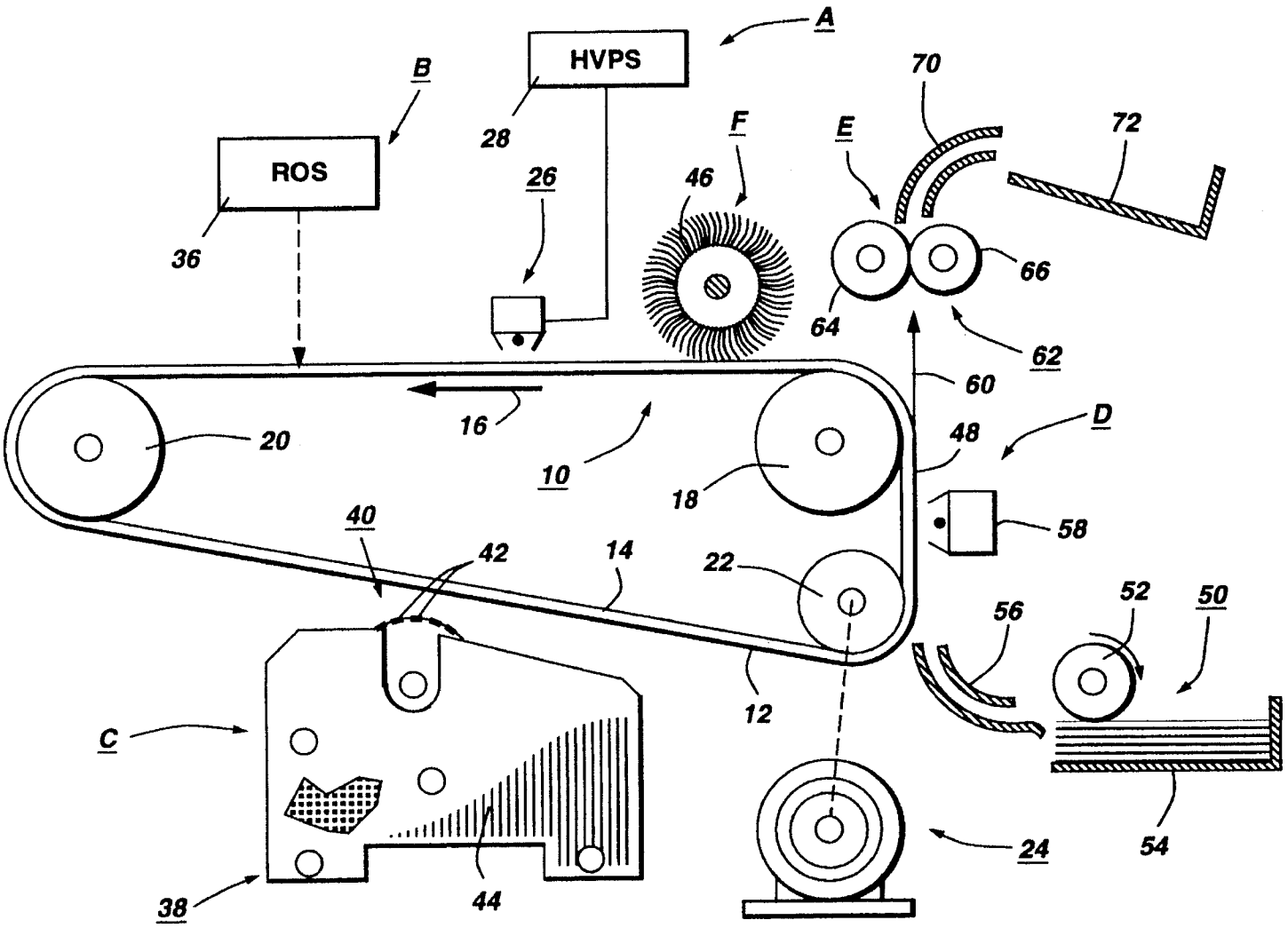
FIG. 5 is a schematic, elevational view of an illustrative electrophotographic printing machine incorporating the FIG. 1 developer unit therein.

Referring initially to FIG. 5, there is shown an illustrative electrophotographic printing machine incorporating the donor roll of the present invention, in a developer unit. The electrophotographic printing machine employs a belt 10 having a photoconductive surface 12 deposited on an electrically grounded substrate 14. One skilled in the art will appreciate that any suitable photoconductive material may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a suitable pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, a raster output scanner (ROS) 30 exposes a raster image in a series of horizontal scan lines with each scan line having a plurality of equally spaced pixels. Typically, a raster output scanner includes a laser source with a rotating polygon mirror, modulation means, and imaging optics.

One skilled in the art will appreciate that instead of a laser ROS, a light emitting semiconductor diode (LED) light bar or suitable light-lens imaging system may be used.

After the electrostatic latent image has been recorded on photoconductive surface 12, belt 10 advances the latent image to development station C. At development station C, a developer unit, indicated generally by the reference numeral 38 develops the latent image recorded on the photoconductive surface. Preferably, developer unit 38 includes one or more donor rolls 40 having the plurality of integral electrical conductors or electrodes disposed thereon. The electrodes are substantially equally spaced and located on the external circumferential surface of donor roll 40. Electrically conductive electrodes 42 are electrically activated with high voltage AC potentials to detach toner particles from the surface of donor roll 40. In this way, a toner powder cloud is created in the gap between donor roll 40 and photoconductive surface 12. The latent image recorded on photoconductive surface 12 attracts toner particles from the toner powder cloud developing a visible toner powder image thereon. Donor roller 40 is mounted, at least partially, in the chamber of developer housing 44. The chamber of developer housing 44 stores a supply of two-component developer material therein. The two-component developer consists of at least carrier granules having toner particles adhering triboelectrically thereto. A magnetic roller disposed wholly within the chamber of housing 44 conveys the developer material to the donor roller. The magnetic roller is electrically biased relative to the donor roller so that the toner particles are attracted from the magnetic roller to the donor roller at a loading zone. Developer unit 38 will be discussed hereinafter in greater detail with reference to FIG. 1.

With continued reference to FIG. 5, after the electrostatic latent image is developed, belt 10 advances the toner powder image to transfer station D. A sheet of support material 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back surface of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F. Cleaning station F includes a rotatably mounted fibrous brush 46 in contact therewith. Subsequent to cleaning, a discharge lamp (not shown) floods photoconductive surface 12 with light to dissipate any residual electrostatic charge prior to recharging the photoconductor surface for the next successive imaging cycle.

It is believed that the foregoing description is sufficient for purposes of the present application to illustrate the general operation of an electrophotographic printing machine incorporating a developer unit having the donor roll of the present invention.

Figure 1:
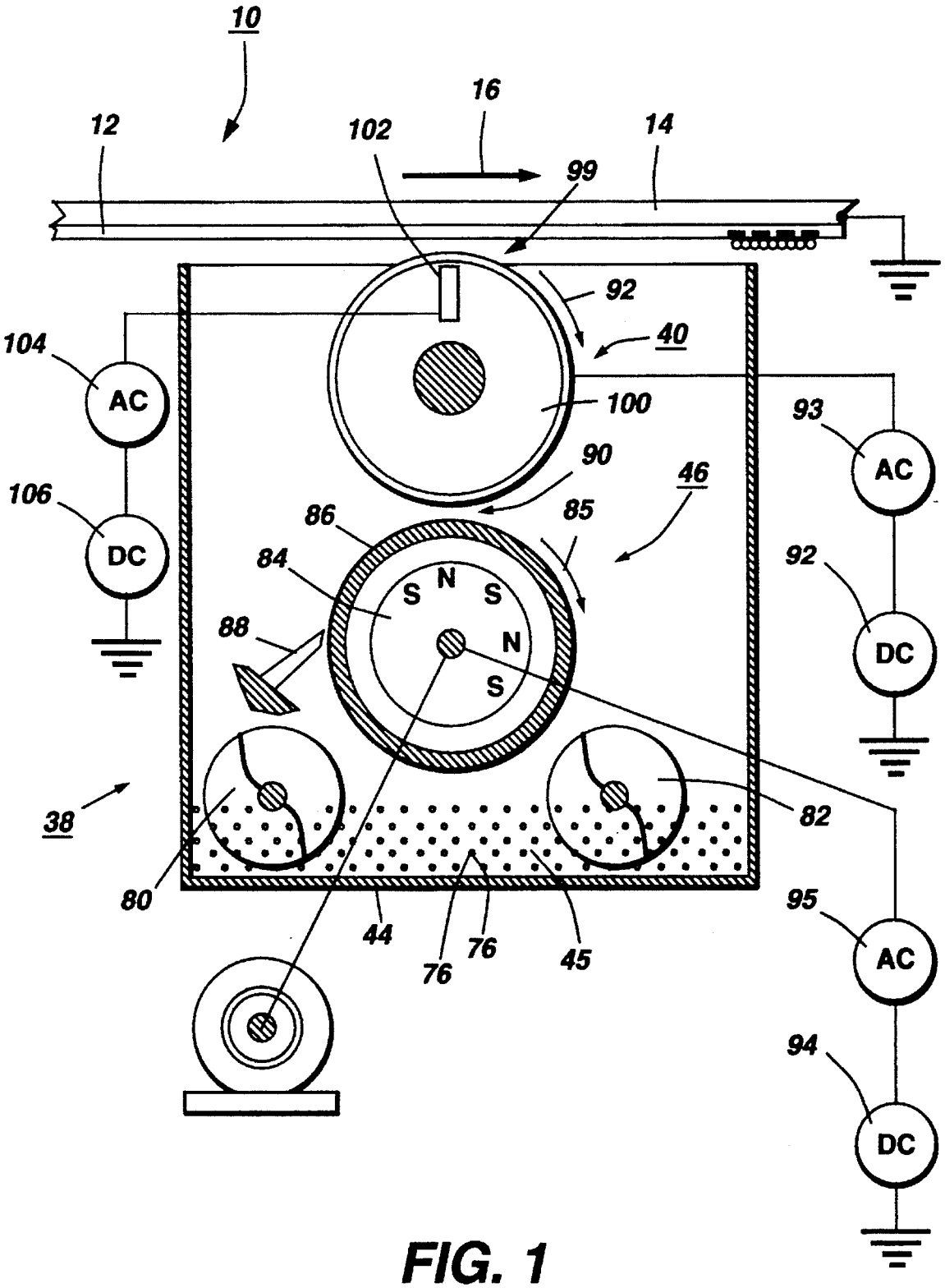
FIG. 1 is a schematic elevational view showing the developer unit used in the FIG. 5 printing machine.

Referring now to FIG. 1, there is shown developer unit 38 in greater detail. Housing 44 defines the chamber for storing a supply of developer material 45 comprised of carrier granules having toner particles adhering triboelectrically thereto. Augers 80 and 82 distribute developer material 45 uniformly along the length of magnetic roller 46 in the chamber of housing 44. Magnetic roller 46 is shown rotating in the direction of arrow 85. An alternating voltage source 95 and a constant voltage source 94 electrically bias magnetic roller 46. Normally both of these voltages are referenced to zero. Magnetic roller 46 includes a closely spaced rotatable sleeve 86 of non-magnetic material, preferably aluminum, surrounding a stationary multi-pole magnet 84. Developer material 45 is attracted to the exterior circumferential surface of sleeve 86 as it rotates through the stationary magnetic fields of magnet 84. A resilient blade 88 meters the quantity of developer material adhering to sleeve 86 as it rotates to loading zone 90. Loading zone 90 is defined as the nip between magnetic roller 46 and donor roller 40. Donor roll 40 has electrically conductive electrodes 42 spaced evenly around its exterior circumferential surface. The electrodes are substantially equally spaced from one another and insulated from the central shaft of donor roll 40 which is electrically conductive. Donor roll 40 rotates in the direction of arrow 92. An AC voltage source 93 and a DC voltage source 92 electrically bias donor roll 40 in loading zone 90. The relative voltages between donor roll 40 and magnetic roller 46 are selected to provide efficient loading of toner on donor roll 40 from the carrier granules adhering to magnetic roller 46. A resistive disk 100 is mounted on the end of donor roll 40. Disk 100 is in sliding contact with brush 102. An AC voltage source 104 and a DC voltage source 106 supply electrical power to brush 102. In this way, an AC voltage difference is applied between adjacent electrodes thereby detaching toner particles from the donor roll surface that form a toner powder cloud in development zone 99. Donor roll 40 is described in further detail with reference to FIGS. 2 through 4.

Figure 2:
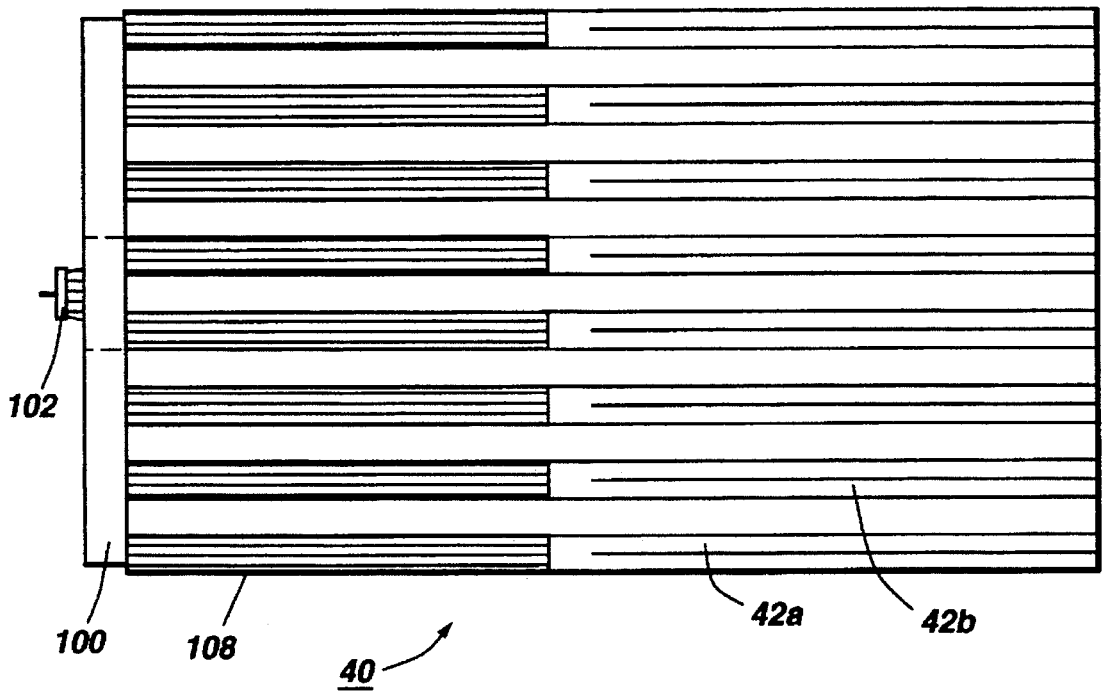
FIG. 2 is a fragmentary, elevational view showing the donor roll used in the FIG. 1 developer unit.

Referring now to FIG. 2, the surface of donor roll 40 is patterned with approximately 100 micron-wide conductive electrodes with approximately 100 micron-wide spacings between them. The electrodes cover the circumferential surface of the roll and are parallel to the longitudinal axis thereof. In FIG. 2, electrodes 42A and 42B are supported on a dielectric insulating polymer material of 20 microns thickness or more which is applied over a metal shaft. By way of example, the polymer coating may be a polyimide-imide liquid formulation, applicable by spray or dip coating, which can be thermally cured so that it is insoluble in the coating solvent. The varying potential for creating the changing electrical fields which drive the toner particles from the surface of the donor roll is applied between the commutated electrodes 42A and common electrodes 42B. The alternating electric fields created between adjacent electrodes act on the charged toner particles, accelerating them from the surface of the donor roll and forming a toner powder cloud in development zone 99. Active electrodes 42A are connected to pads 108. The active electrodes 42A and the common electrodes 42B form an inter-digited pattern about the periphery of the dielectric layer of the donor roll 40. Active electrodes 42A are electrically connected to pads 108 and electrodes 42B are connected to a common potential with one common electrode 42B interposed between each active electrodes 42A. The two sets of electrodes are evenly spaced apart from one another. Conductive pads 108 are electrically connected to resistive member 100. Resistive member 100 is a carbon ring shown in greater detail with reference to FIG. 4. Brush 102 is electrically connected to AC voltage source 104 and DC voltage source 106 (FIG. 1). As donor roll 40 rotates, carbon ring 40 and conductive pads 108 mounted on the donor rolls turn as a unit. Brush 102 is in sliding contact with carbon ring 100. Arcing between conductive electrodes will occur when the dielectric breakdown strength of the surrounding medium, i.e. air, is less than the applied electric fields. For air, the Pashen minimum breakdown strength is approximately 250 volts over a gap of about 8 microns or roughly 800 volts per mil. Therefore, for a spacing between electrodes of 4 to six mils, the maximum voltage between electrodes cannot exceed 3200 volts. Carbon ring 100 is selected such that its thickness and resistance/area, i.e., ohms per square, is such that this electric field strength is not exceeded. The carbon ring makes continuous electrical contact with all the electrodes on the doner roll surface, and the potential of each electrode varies as the roll is made to rotate. As the roll turns, the voltage amplitude on the electrode closest to brush 102 approaches the potential of the brush. Electrodes displaced away from the brush have a proportionally lower applied potential.

Figure 3:
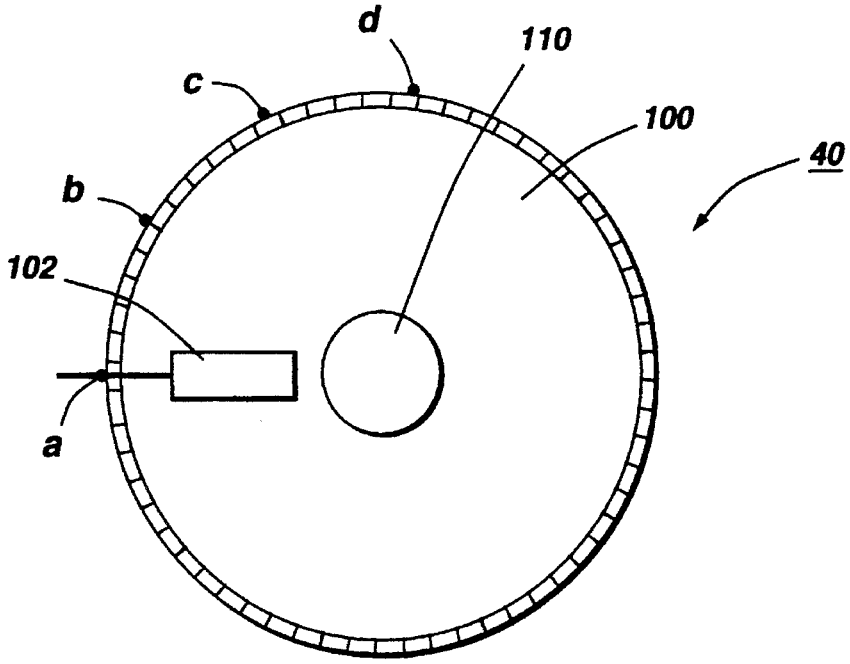
FIG. 3 is an elevational view of the FIG. 2 donor roll.

Referring now to FIG. 3, there is shown a side elevational view of the donor roll shown in FIG. 2. The applied voltage on the electrode 42A in closest proximity to brush 102 is a maximum, i.e. nominally 1000 volts. As the doner roll turns, this electrode moves away from brush 102, and the voltage is attenuated to lower and lower values. For example, at point B in the figure, the voltage has decreased to 500 volts, at point C the voltage is only 100 volts and when roller 40 has rotated about 90 degrees to point E, the voltage falls below 10 volts. As shown in FIG. 3, donor roll 40 rotates about shaft 110. One skilled in the art will appreciate that the active electrodes 42A may be directly connected electrically to carbon ring 100 rather than through pads 108.

Figure 4:
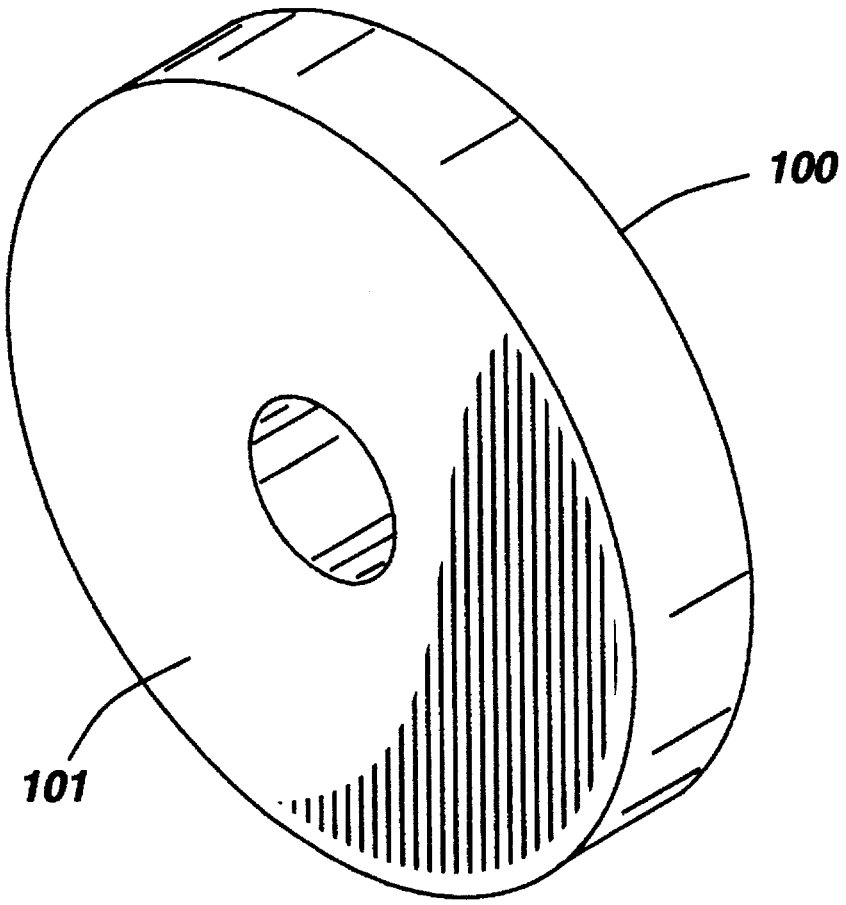
FIG. 4 is a perspective view showing the resistive member used in the FIG. 1 donor roll.

Carbon ring 100, shown in greater detail in FIG. 4, is approximately 0.10 millimeters thick and 25 millimeters in diameter and is provided with a clearance hole 101 for placement over shaft 110. Pads 108 make Ohmic contact with the inner surface of carbon ring 100. Alternatively, active electrodes 42A may be electrically connected directly to carbon ring 100.

In recapitulation, it is evident that the donor roll of the present invention includes electrically conductive electrodes in contact with a resistive ring. The resistive ring is in sliding contact with a brush connected to a voltage source. As the donor roll and ring are rotated, the electrical voltage applied to each electrode varies as a function of the distance of that electrode from the brush. The carbon ring distributes a continuously varying potential to the electrodes so that the dielectric strength of the medium between adjacent electrodes is not exceeded even at very high applied potentials, and discharge-free commutation is provided.

It is, therefore, apparent that there has been devised in accordance with the present invention a donor roller for use in a developer unit that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface, including:

a movable donor member;

a plurality of conductive electrodes mounted on said donor member and adapted to move in unison therewith;

a resistive member connected electrically to said plurality of conductive electrodes and adapted to move in unison therewith; and a voltage source mounted stationarily and coupled electrically to said resistive member, said resistive member being made from a material which prevents a maximum voltage between adjacent ones of said plurality of conductive electrodes from exceeding a dielectric breakdown voltage of air with a voltage applied to one of said plurality of conductive electrodes varying as a function of the distance between said voltage source and said one of said plurality of conductive electrodes.

2. An apparatus according to claim 1, further including a stationarily mounted electrically conducting member connected electrically to said voltage source and in sliding contact with said resistive member.

3. An apparatus according to claim, 2, wherein:

said donor member includes a roll having said plurality of conductive electrodes mounted thereon; and said resistive member includes a disc mounted adjacent an end of said roll.

4. An apparatus according to claim 3, wherein said conducting member includes a brush.

5. An apparatus according to claim 4, wherein said plurality of conductive electrodes includes:

a first set of spaced apart conductive electrodes; and a second set of spaced apart conductive electrodes, each electrode of said second set of conductive electrodes being interposed between adjacent electrodes of said first set of conductive electrodes.

6. An apparatus according to claim 5, further including an electrically conductive pad mounted on said roll and electrically connecting at least two adjacent conductive electrodes of said first set of conductive electrodes with said pad being electrically connected to said disc.

7. A donor roll for use in a developer unit of a printing machine, including:

a roller mounted rotatably;

a plurality of conductive electrodes mounted on said roller and adapted to move in unison therewith; and a resistive member connected electrically to said plurality of conductive electrodes and adapted to move in unison therewith said resistive member being made from a material which prevents a maximum voltage between adjacent ones of said plurality of conductive electrodes from exceeding a dielectric breakdown voltage of air and a voltage applied to one of said plurality of conductive electrodes varying as a function of the distance between a source of that voltage and said one of said plurality of conductive electrodes.

8. A donor roll according to claim 7, wherein said resistive member includes a disc mounted adjacent an end of said roll.

9. A donor roll according to claim 8, wherein said plurality of conductive electrodes includes:

a first set of spaced apart conductive electrodes; and a second set of spaced apart conductive electrodes, each electrode of said second set of conductive electrodes being interposed between adjacent electrodes of said first set of conductive electrodes.

10. A donor roll according to claim 9, further including an electrically conductive pad mounted on said roll and electrically connecting at least two adjacent conductive electrodes of said first set of conductive electrodes with said pad being electrically connected to said disc.

11. A donor roll according to claim 10, further including a voltage source mounted stationarily and coupled electrically to said disc so that a voltage applied to one of said plurality of conductive electrodes varies as a function of the distance between said voltage source and said one of said plurality of conductive electrodes.

12. A donor roll according to claim 11, further including a stationarily mounted electrically conducting member connected electrically to said voltage source and in sliding contact with said resistive member.

13. A donor roll according to claim 12, wherein said conducting member includes a brush.

14. A printing machine of the type having a latent image recorded on a surface, wherein the improvement includes:

a movable donor member adapted to move toner adjacent the surface;

a plurality of conductive electrodes mounted on said donor member and adapted to move in unison therewith;

a resistive member connected electrically to said plurality of conductive electrodes and adapted to move in unison therewith; and a voltage source mounted stationarily and coupled electrically to said resistive member, said resistive member being made from a material which prevents a maximum voltage between adjacent ones of said plurality of conductive electrodes from exceeding a dielectric breakdown voltage of air with a voltage applied to one of said plurality of conductive electrodes varying as a function of the distance between said voltage source and said one of said plurality of conductive electrodes with the voltage detaching toner from said donor member to develop the latent image recorded on the surface.

15. A printing machine according to claim 14, further including a stationarily mounted electrically conducting member connected electrically to said voltage source and in sliding contact with said resistive member.

16. A printing machine according to claim 15, wherein:

said donor member includes a roll having said plurality of conductive electrodes mounted thereon; and said resistive member includes a disc mounted adjacent an end of said roll.

17. A printing machine according to claim 16, wherein said conducting member includes a brush.

18. A printing machine according to claim 17, wherein said plurality of conductive electrodes includes:

a first set of spaced apart conductive electrodes; and a second set of spaced apart conductive electrodes, each electrode of said second set of conductive electrodes being interposed between adjacent electrodes of said first set of conductive electrodes.

19. A printing machine according to claim 18, further including an electrically conductive pad mounted on said roll and electrically connecting at least two adjacent conductive electrodes of said first set of conductive electrodes with said pad being electrically connected to said disc.

* * * * *